US005159389A

United States Patent [19]

Minami et al.

[11] Patent Number: 5,159,389

[45] Date of Patent: Oct. 27, 1992

[54] ELECTROSTATIC LATENT IMAGE APPARATUS

[75] Inventors: Koji Minami, Higashiosaka; Toshihiko Yamaoki, Osaka; Tomonori Nagashima; Kenichiro Wakisaka, both of Hirakata, all of Japan

[73] Assignee: Sanyo Electric Co., Ltd., Osaka, Japan

[21] Appl. No.: 782,770

[22] Filed: Oct. 18, 1991

Related U.S. Application Data

[63] Continuation of Ser. No. 421,075, Oct. 13, 1989, abandoned.

[30] Foreign Application Priority Data

Aug. 30, 1988 [JP] Japan ..... 1-223379
Oct. 15, 1988 [JP] Japan ..... 63-260216

[51] Int. Cl.[5] ..... G03G 15/04

[52] U.S. Cl. ..... 355/211; 430/31; 430/66; 355/232; 355/241

[58] Field of Search ..... 430/31; 355/211, 232, 355/241

[56] References Cited

U.S. PATENT DOCUMENTS

| | | | |
|---|---|---|---|
| 4,265,991 | 5/1981 | Hirai et al. | 430/95 X |
| 4,536,460 | 8/1985 | Kanbe et al. | 430/95 X |
| 4,642,278 | 2/1987 | Tanigami et al. | 430/95 X |
| 4,666,803 | 5/1987 | Yamazaki | 430/57 |
| 4,687,724 | 8/1987 | Ehara et al. | 430/95 X |
| 4,886,724 | 12/1989 | Masaki et al. | 430/66 |
| 4,921,768 | 5/1990 | Kunugi et al. | 430/31 X |

*Primary Examiner*—Roland Martin
*Attorney, Agent, or Firm*—Darby & Darby

[57] ABSTRACT

An electrostatic latent image member for use in an electrophotographic machine which can simultaneously perform such as charge not by a corona discharge, exposure, developing, cleaning, and the like, where a photosensitive unit including a photoconductive layer is laminated on a transparent supporting member, and the photosensitive unit which is added with an element for trapping an electric charge being injected in the vicinity of its surface can trap the electric charge being injected therein by a magnetic brush making contact with the outer surface of the photosensitive unit.

17 Claims, 9 Drawing Sheets

ELECTROSTATIC LATENT IMAGE APPARATUS

This is a continuation of application Ser. No. 421,075, filed Oct. 13, 1989.

BACKGROUND OF THE INVENTION

1. Field of the Invention

The present invention relates to an electrostatic charge latent image member for use in such as an electrophotographic machine capable of simultaneously performing such process as charge not by the corona discharge, exposure, developing, cleaning and the like.

2. Description of Related Art

As for an electrophotographic machine, the one that employing the corona discharge is generally well known. FIG. 1 is a schematic view showing an electrophotographic machine employing the corona discharge. In the figure, there are arranged around an electrostatic latent image member 30 a charger 31 for performing such process as corona charge, exposure, developing, transfer, cleaning, erasing, or the like, a developing unit 32, a transfer unit 33, a cleaner 35, an erasing lamp 34, and the like. The electrostatic latent image member 30 is to take the following process repeatedly while being rotated. The electrostatic latent image member 30 is electrified by the charger 31 so as to form an electrostatic latent image by projecting an optical image, and then the developing unit 32 forms a toner image and the transfer unit 33 transfer it on a recording paper 37 and a fixing unit 36 fixes it on the recording paper 37. At that time, the cleaner 35 removes residual toner and the erasing lamp 34 erases residual electrostatic charge. Accordingly, there has been a disadvantage that both constitution and process of the conventional machine is complicated.

In order to avoid this disadvantage, the electrophotographic machine not employing the corona discharge is proposed recently in such as J. Appl. Phys., Vol. 63, No. 11, Jun. 1, 1988. FIG. 2 is a schematic view showing an electrophotographic machine not employing corona discharge where there are arranged a magnetic brush 41 on the upper periphery of the electrostatic latent image member 40, a transfer roller 42 on the lower periphery of the electrostatic latent image member 40, and an LED array head 43 inside the electrostatic latent image member 40.

The electrostatic latent image member 40 is composed of layers, a transparent electrode **40*b*, and a photoconductive layer 40*c* comprised in a photosensitive unit on the outer periphery of a transparent supporting member 40*a* made of glass. Between the transparent electrode 40*b* and a magnetic roller 41*a* in the magnetic brush 41, applied developing bias. Low-resistance toner is to be stuck to around a sleeve 41*b* which covers the periphery of the magnetic roller 41*a* to form the so-called magnetic brush 41, the magnetic brush 41 being in contact with the periphery of the photoconductive layer 40*c*, generates a strong electric field between the surface of the magnetic brush 41 and the photoconductive layer 40*c*. In this state, the conductive toner layer rubs the photoconductive layer 40*c* to intensify their electric contact with each other so that electric charge is easily to be injected, and by the injected electric charge being trapped the photoconductive layer 40*c* is to be electrified. When the electrostatic latent image member 40 is electrified up to generally the same potential as that of the toner layer, electric attraction is not generated between the toner and the electrostatic latent image member 40, so that the toner is prevented from sticking to the surface of the photoconductive layer 40*c*. In this state, because when an optical image projected from a head 43 enters the photoconductive layer 40*c* from the inside of the transparent supporting member 40*a*, potential of its exposed portion is reduced, according to the principle of the inversion, the toner comes apart from the magnetic brush 41 and then sticks to the photoconductive layer 40*c* to form a toner image which is to be transferred on a recording paper 44 by a transfer roller 42**.

Residual toner on the surface of the electrostatic latent image member 40 is removed by both scrubbing force of the magnetic brush 41 and magnetic force of the magnetic roller **41*a*. Accordingly, charge, exposure, developing, and cleaning of the electrostatic latent image member 40 are generally simultaneously performed by the magnetic brush 41 and the head 43**, which results in such an advantage that constitution and process of this apparatus is greatly simplified.

However, in the photosensitive unit of this electrophotographic machine being different from that of the conventional one, mainly travels a carrier with polarity opposite to that of charge of the photosensitive unit, which results that it is difficult for this photosensitive unit to obtain clear images.

As has been aforementioned, for the above-mentioned electrophotographic machine, it is necessary that the injected electric charge by the toner layer should be trapped at the electrophotographic process.

SUMMARY OF THE INVENTION

The foregoing disadvantage is overcome in accordance with the present invention.

It is a first object of the invention to provide an electrostatic latent image member which can surely trap the electric charge on the surface of a photosensitive unit to realize such high photo-conductivity as to obtain clear images with low surface-potential.

It is a second object of the invention to provide an electrostatic latent image member which has a photoconductive layer wherein mobility of a carrier is greater when the carrier has a polarity which is opposite to the polarity of the electric surface potential than when the carrier has a polarity which is the same or equal to the polarity of the electric surface potential.

It is a third object of the invention to provide an electrostatic latent image member which includes 1 to 40 atomic percent of H to realize such high photo-conductivity as to obtain clear images with low surface-potential.

The above and further objects and features of the invention will more fully be apparent from the following detailed description with accompanying drawings.

DESCRIPTION OF THE PREFERRED EMBODIMENTS

Referring now to the accompanying drawings, preferred embodiments of the invention are described below in detail.

Figure 3:
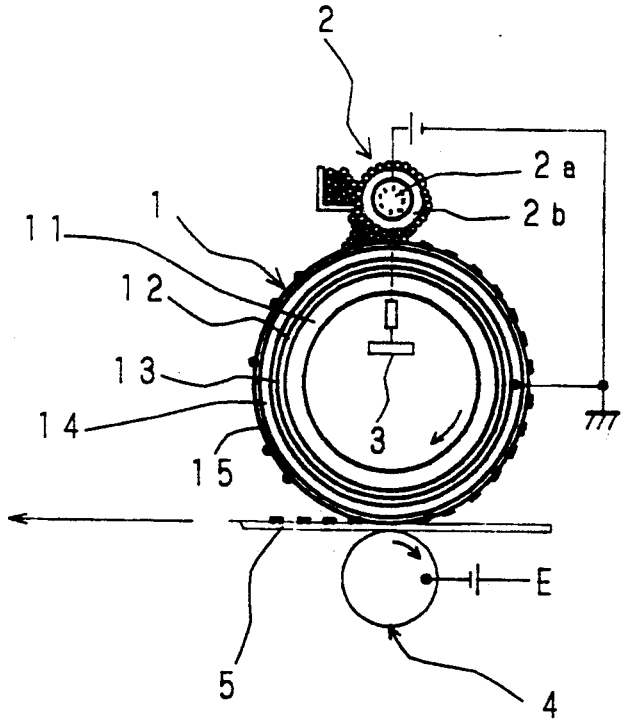
FIG. 3 is a schematic view showing an arrangement of an electrophotographic machine of the present invention.

FIG. 3 is a schematic view of an electrophotographic employing an electrostatic latent image member in accordance with the present invention. Numeral 1 represents an electrostatic latent image member of the invention, 2 a magnetic brush, 3 an LED array head, 4 a transfer roller, and 5 a recording paper.

The electrostatic latent image member 1 being in cylindrical form is driven to rotate around a shaft (not shown) in the direction shown by the arrow. Facing the upper portion of periphery of the electrostatic latent image member 1, arranged the magnetic brush 2 for performing charge, developing, erasing, cleaning or the like, and opposite to the magnetic brush 2, inside the electrostatic latent image member 1, arranged the LED array head 3 for performing exposure, and facing the lower portion of periphery of the electrostatic latent image member 1 arranged the transfer roller 4 for transferring a toner image on the recording paper 5.

Figure 4:
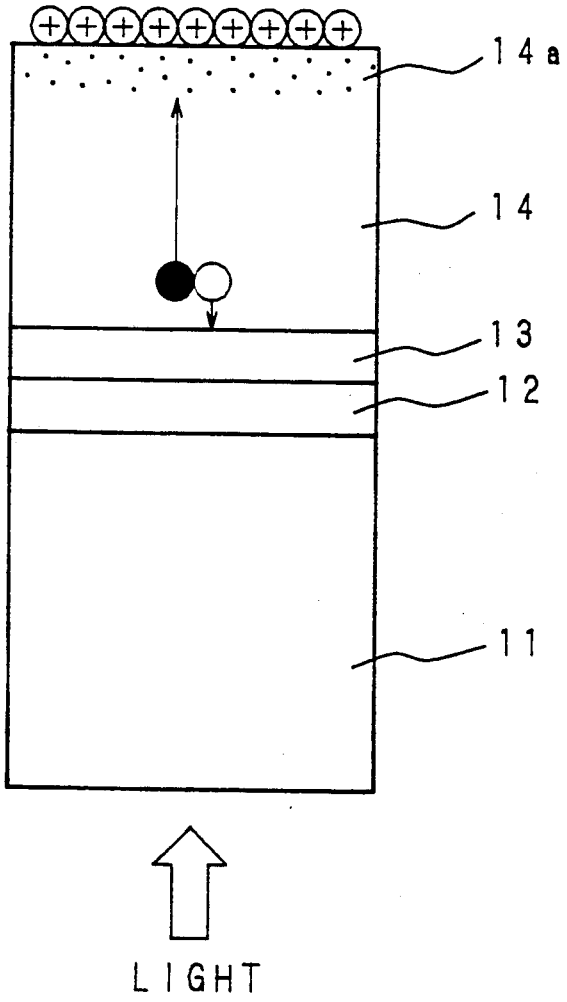
FIGS. 4 and 5 are schematically partially sectional views of an electrostatic latent image member of the present invention.

FIG. 4 is a fragmentary sectionally constitutional view illustrating one example of the electrostatic latent image member 1 in accordance with the present invention. In the figure, reference numeral 11 designates a transparent supporting member made of glass, etc. On the transparent supporting member 11 provided a photosensitive unit which is layered in such order from the outer surface as a transparent electrode 12 comprising such as ITO, $SnO_2$, or the like, a blocking layer 13 mainly made of amorphous silicon, and a photoconductive layer 14 also being mainly made of amorphous silicon.

In the following, two kinds of embodiments will be expressed according to the electrophotographic latent image member of the present invention, one is to improve charge performance with an insulating thin film surface layer, and another is additionally to dope in the vicinity of the surface of its photoconductive layer an element 14*a* for trapping the electric charge injected from a toner layer. The element 14*a* employed for an electrostatic latent image member with negative charge is such an element as boron, aluminium, gallium, indium, or the like which belongs to III—a group of the periodic table and for an electrostatic latent image member with positive charge is such an element as antimony, arsenic group, phosphorus, nitrogen, or the like which belongs to V—a group of the periodic table.

Figure 5:
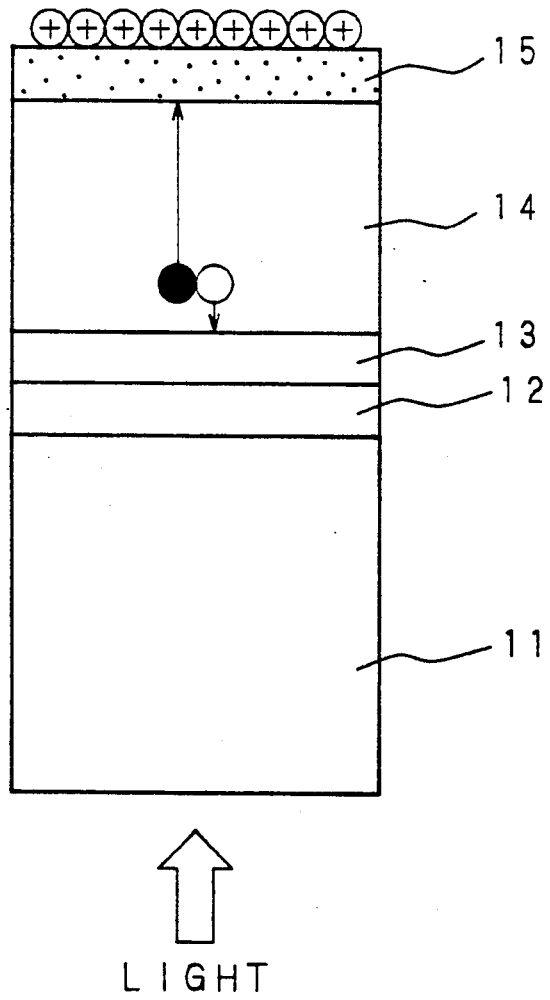

FIG. 5 is a fragmentary sectionally constitutional view showing another embodiment of the electrostatic latent image member 1 in accordance with the present invention. In the figure, reference numeral 11 designates a transparent supporting member made of glass, etc. On the transparent supporting member 11 provided a photosensitive unit which is layered in such order as a transparent electrode 12 comprising such as ITO, $SnO_2$, or the like, a blocking layer 13, and a photosensitive unit being layered a photoconductive layer 14 mainly composed of amorphous silicon, and a surface layer 15 mainly composed of amorphous silicon in this order.

Conditions for forming the photoconductive layer 14 are illustrated as in Table 1.

There are two embodiments according to the electrostatic latent image member of the present invention, one is to use an insulating thin film, and another is to dope on its surface layer 15 the element 14*a* for trapping electric charge injected from the toner layer. The element 14*a* employed for the electrostatic latent image member with negative charge is such an element as boron, aluminium, gallium, indium, or the like which belongs to III—a group of the periodic table, and for the electrostatic latent image member with positive charge is such an element as antimony, arsenic group, phosphorus, nitrogen or the like which belongs to V—a group of the periodic table.

In order to obtain higher photo-conductivity, H content of each, the blocking layer 13, the photoconductive layer 14, the surface layer 15, and the whole photosensitive unit being composed of these three layers are set to be 1 to 40 atomic percent, and preferably to be 8 to 30 atomic percent, respectively.

B content in the photoconductive layer 14 is set to be as $0 \leqq B/Si \leqq 2 \times 10^{-4}$ atomic percent, in addition O content to be as $0 < O/Si \leqq 0.1$ atomic percent.

Each film thickness of the blocking layer 13 and the surface layer 15 is 0.01 to 1.0 μm, and the whole thickness of the blocking layer 13, the photoconductive layer 14, and the surface layer 15 together is substantially 0.5 to 10 μm, and preferably 0.5 to 5 μm, and more preferably 0.5 to 1 μm.

Figure 1:
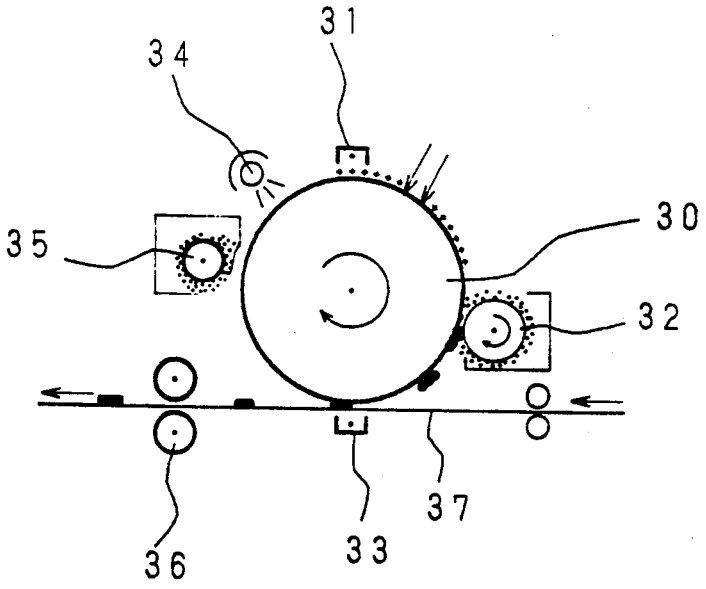
FIG. 1 is a schematic view showing an arrangement of an electrophotographic machine employing the corona discharge.
Figure 2:
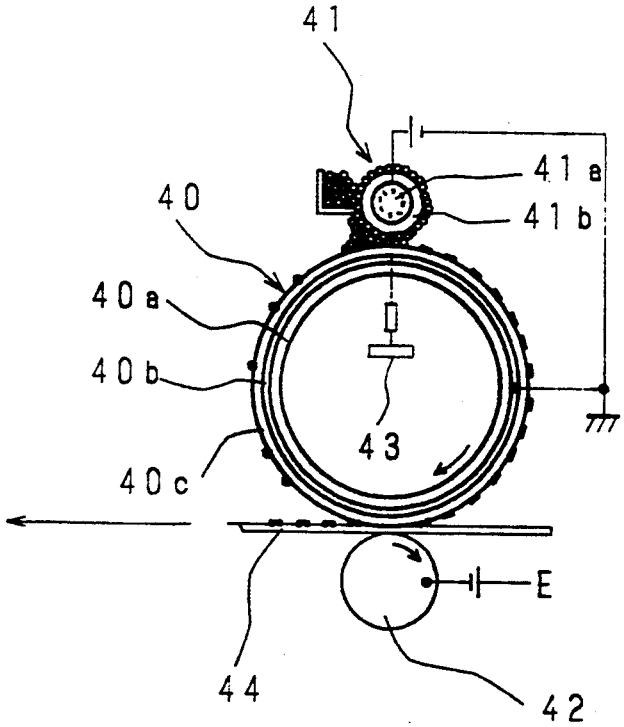
Fig. 2 Prior Art
FIG. 2 is a schematic view showing an arrangement of an electrophotographic machine not employing the corona discharge.

Those thicknesses of the films are not necessarily limited to such as referred above, and, in general, films are able to be thinner than those being mainly made of amorphous silicon which have been developed for the electrophotographic machine employing the corona discharge shown in FIG. 1. However, any thickness is proper when taking the proper light absorption under a determined wavelength into account to set certain values.

In the embodiments, the electrostatic latent image member with negative charge is taken for an example, in which boron (B) is employed as the doping element. To put it concretely, $B_2H_6$ gas is injected therein at a predetermined flow ratio in the vicinity of the surface of the photoconductive layer 14 shown in FIG. 4 or in the surface layer 15 shown in FIG. 5 when the layer is formed.

As for the electrostatic latent image member of such constitution as described above in accordance with the present invention, when the surface of either the photoconductive layer 14 or the surface layer 15 is positively charged by the magnetic brush 2, then, on the contrary, the surface of the transparent electrode 12 is negatively charged, so that the blocking layer 13 holds the state without contradicting those positive and negative electric charges with each other. In that state, when the LED array head 3 projects an optical image from the side of the transparent supporting member 11, the light penetrates both the transparent supporting member 11 and the transparent electrode 12 and then enters the photoconductive layer 14 being comprised in the photosensitive unit, and the light energy produces carriers, that is, electrons and holes. Accordingly, as may clearly be shown in FIGS. 4 and 5, the position where the electrons and the holes are produced is the area nearby the blocking layer 13 inside the photoconductive layer 14. The produced electrons are transported to the side of the positively electrified surface layer 15, while the produced holes are transported to the side of the negatively electrified transparent electrode 12, respectively.

Figure 6:
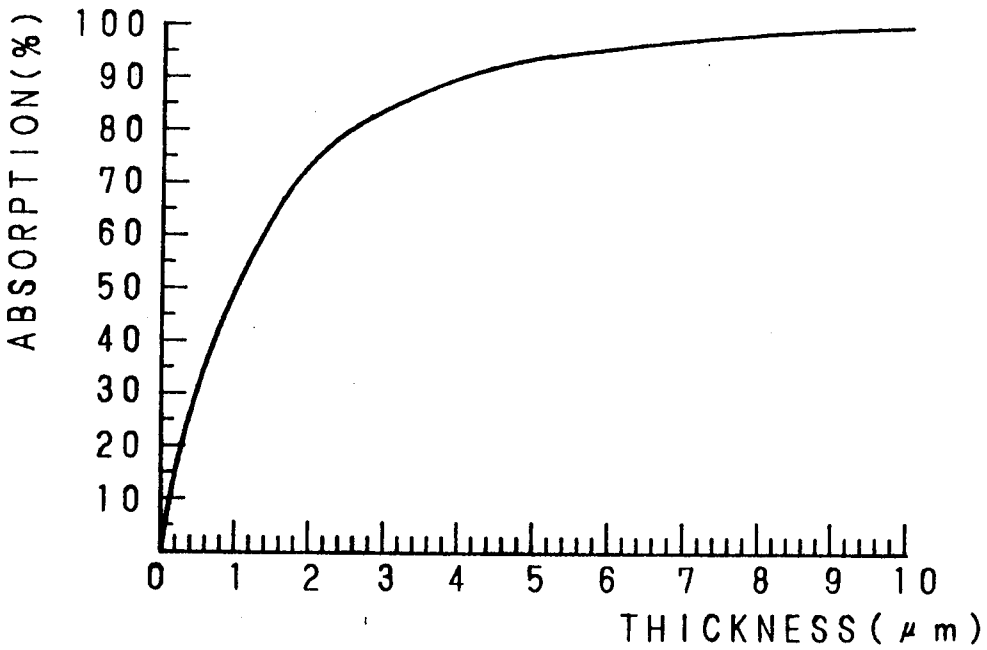
FIG. 6 is a graph showing percentage of absorption of a typical amorphous silicon film under light with 660 nm wavelength.

Incidentally, absorption of a typical amorphous silicon film (Eopt 1.68 eV) under the light with 660 nm of wavelength is as shown in FIG. 6. In FIG. 6, the horizontal axis designates film thickness ($\mu$m) and the vertical axis designates absorption (percentage) of film, where the film with 4 $\mu$m of thickness has generally 90 percent in its absorption.

Figure 7:
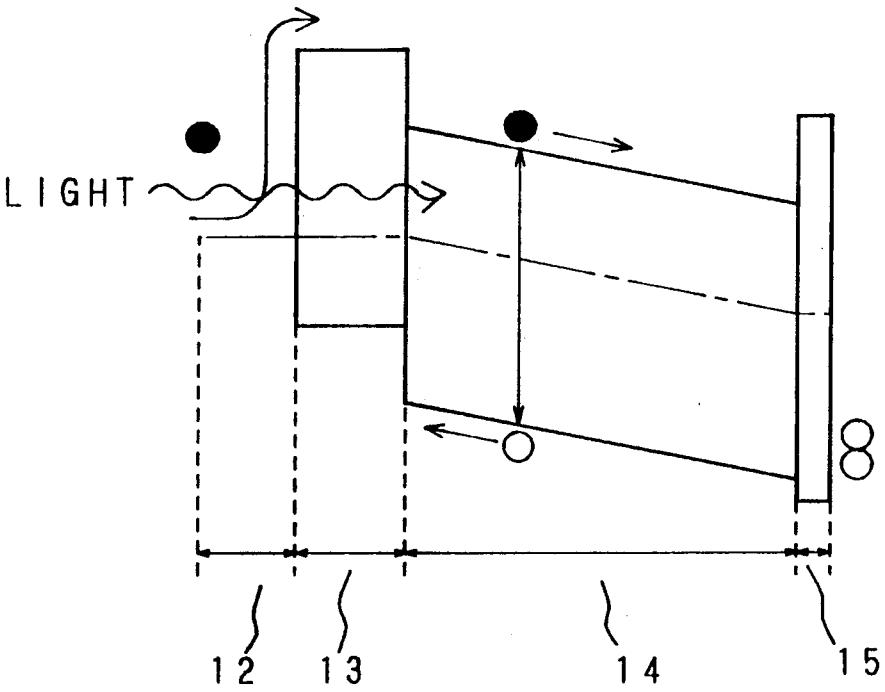
FIG. 7 is a graph showing energy bands of a transparent electrode and a photosensitive unit.

FIG. 7 illustrates energy bands of the photosensitive unit including the transparent electrode 12. As can be seen from the figure, substantially most light which has penetrated the transparent electrode 12, the blocking layer 13, and the photoconductive layer 14 is absorbed in the area nearby the blocking layer 13, where electrons and holes are produced. Those produced electrons are transported a long way off to the side of the surface layer 15, while the produced holes are transported a shorter way to the side of the blocking layer 13. In other words, the transported distance of the carrier is longer with polarity opposite to that of the potential of the surface layer 15 than with the equal polarity to that of the potential of the surface layer 15. Therefore, the transportation of the electron transported longer becomes more important, and because the transportation depends on $B_2H_6$ concentration, the transportation of the electron is determined by selecting the precise $B_2H_6$ concentration for it.

Figure 8:
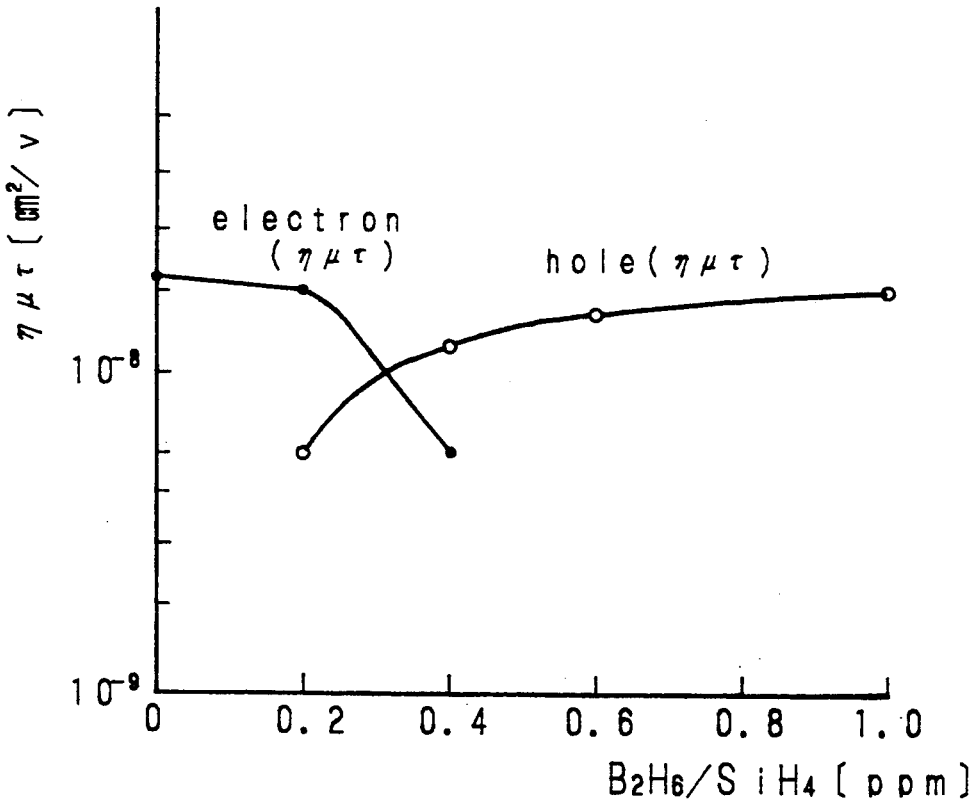
FIG. 8 is a graph showing dependence of transportations of an electron and a hole on a $B_2H_6$ concentration photoconductive layer.

FIG. 8 is a graph showing the dependence on $B_2H_6$ concentration of the transportation ($\eta\mu\tau$ $\eta$: quantum efficiency, $\mu$: mobility, $\tau$: life) of the electron and the hole in the photoconductive layer, in which the horizontal axis designates flow ratio (ppm) of $B_2H_6$ to $SiH_4$ and the vertical axis designates $\eta\mu\tau$.

As may be obviously seen from the graph, the transportation of the electron is higher in the range of 0 to 0.4 ppm of $B_2H_6/SiH_4$, and that of the hole is higher in the range of 0.2 to 10 ppm of $B_2H_6/SiH_4$. In general, the concentration value of the electrostatic latent image member may be preferable 0 to 0.4 ppm of $B_2H_6/SiH_4$ for positive charge, while 0.2 to 10 ppm for negative charge.

There is a need to trap the electric charge injected from the toner layer in the vicinity of the surface of the photoconductive layer 14 for the embodiment shown in FIG. 4, and in the surface layer 15 for the embodiment shown in FIG. 5. In order to trap the electric charge, it is necessary to thicken B concentration in the vicinity of the surface of the photoconductive layer 14 or in the surface layer 15. In order to meet that need, the present invention applies an insulating thin film to the surface layer 15 to improve charge performance, and additionally sets higher value of B concentration in the vicinity of the surface of the photoconductive layer 14 or in the surface layer 15 so as to trap the electric charge.

Now one embodiment of the present invention will concretely be explained with reference to FIG. 9.

Figure 9:
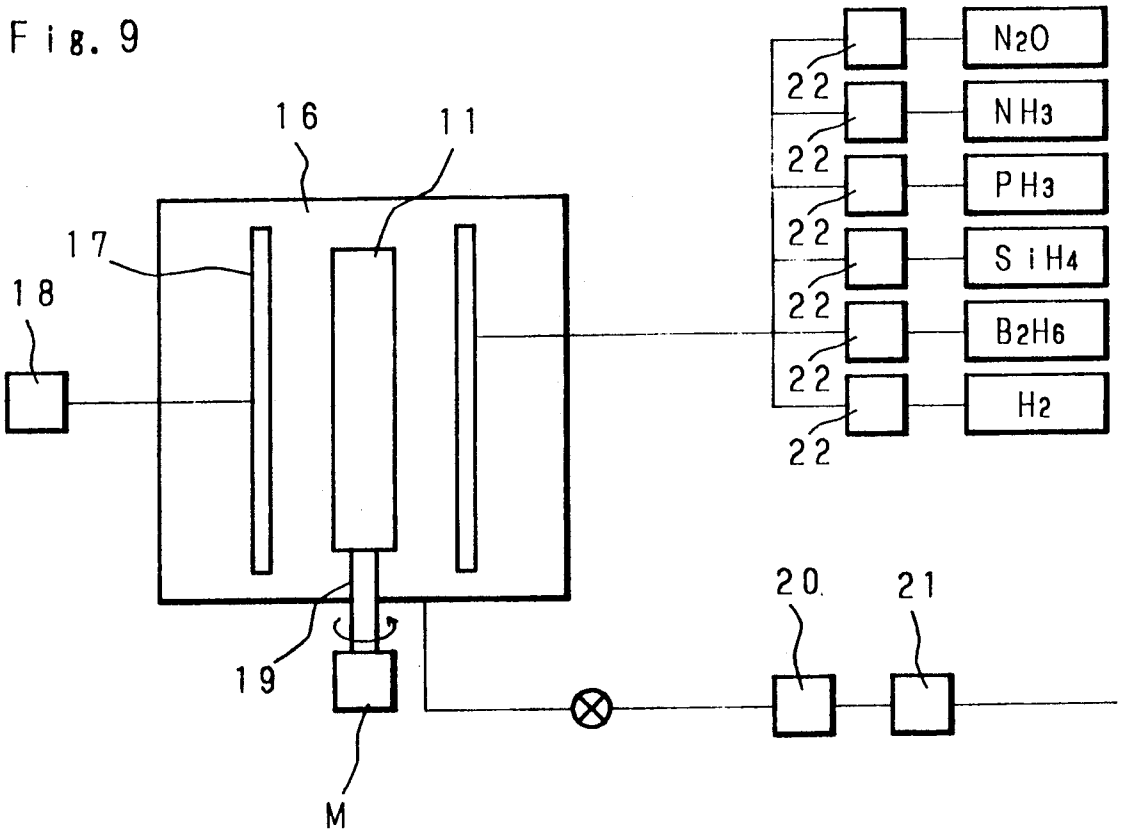
FIG. 9 is a block diagram showing an arrangement of an apparatus for producing an electrostatic latent image member of the present invention.

FIG. 9 is a schematic view of an apparatus for producing the electrostatic latent image member 1 in accordance with the present invention. In the figure, numeral 16 designates a reaction chamber, and the reaction chamber 16 is a hollow cylinder with both ends being sealed. In the reaction chamber 16, a cylindrical discharge electrode 17 is concentrically arranged, which is connected to a high frequency power source 18. In the center of the bottom of the reaction chamber 16, a shaft 19 is vertically pivoted, to the lower end of which is concentrically fixed a motor M and to the upper end is concentrically amounted a transparent supporting member 11 with a transparent electrode 12 on its surface. The transparent supporting member 11 is driven to rotate being headed by a heater (not shown) which is arranged inside the reaction chamber 16.

To the reaction chamber 16 is connected a mechanical booster pump 20, a rotary pump 21, and further gas tanks through each flow adjuster 22 in parallel.

Each gas tank contains $N_2O$, $NH_3$, $PH_3$, $SiH_4$, $B_2H_6$, $H_2$, and so forth, respectively, and the flow adjuster 22 supplies each of them into the reaction chamber 16 by each predetermined volume.

While the transparent supporting member 11 with the transparent electrode 12 on the surface is being rotated, it is heated up to approximately 270° C. by the heater, and $SiH_4$ gas and the reaction gasses according to such forming conditions as shown in Tables 2 through 17 are made to flow into the reaction chamber 16 so as to maintain the predetermined pressure therein. And on the transparent supporting member 11 with earth potential, the high frequency power source 18 applying 13.56 MHz of high frequency (RF) to the discharge electrode 17 with the predetermined output, formed the blocking layer 13, the photoconductive layer 14, and the surface layer 15.

The following examples of electrostatic latent image member produced by the apparatus shown in FIG. 9 further illustrate preferred operations within the scope of the present invention.

EXAMPLE 1

The electrostatic latent image member is formed under such conditions as shown in Table 2.

From the result of measurement of transportations $\eta\mu\tau$ of the electron and the hole so as to evaluate a performance of the obtained electrostatic latent image member under such conditions as shown in Table 2, the following results are established:

$$electron\ \eta\mu\tau = 2.2\times10^{-8}\ cm^2/V$$

$$hole\ \eta\mu\tau < 5\times10^{-9}\ cm^2/V.$$

Comparing those results, it can be seen that the electron with reverse polarity to the surface potential has higher transportation than the hole.

EXAMPLE 2

The electrostatic latent image member is formed under such conditions as shown in Table 3.

The blocking layer is produced with $PH_3$ instead of $B_2H_6$ to form an amorphous silicon layer of n-type conductivity, and the photoconductive layer is produced by doping $B_2H_6/SiH_4$ ppm = 1 ppm.

From the result of measurement of transportations $\eta\mu\tau$ of the electron and the hole so as to evaluate a performance of the obtained electrostatic latent image member, the following results are established:

electron $\eta\mu\tau < 5\times10^{-9}\ cm^2/V$ hole $\eta\mu\tau = 2\times10^{-8}\ cm^2/V$.

Comparing those results, it can be seen that the hole has higher transportation than the electron.

EXAMPLE 3

The electrostatic latent image member is formed under such conditions as shown in Table 4 by varying thickness of each layer and ratio of $NH_3/SiH_4$. Other conditions are substantially the same as in Example 1.

From the result of measurement of transportations $\eta\mu\tau$ of the electron and the hole so as to evaluate a performance of the obtained electrostatic latent image member, the following results are established:

electron $\eta\mu\tau = 4.0\times10^{-8}\ cm^2/V$ hole $\eta\mu\tau < 5\times10^{-9}\ cm^2/V$.

Comparing those results, it can be seen that the electron has higher transportation than the hole.

EXAMPLE 4

The electrostatic latent image member is formed under such conditions as shown in Table 5. The blocking layer 13 is produced with $PH_3$ instead of $B_2H_6$ to form an amorphous silicon layer of n-type conductivity, and the photoconductive layer 14 is produced by doping $B_2H_6/SiH_4 = 1$ ppm with 5 μm of its film thickness. Other conditions are substantially the same as in Example 1.

From the result of measurement of transportations $\eta\mu\tau$ of the electron and the hole so as to evaluate a performance of the obtained electrostatic latent image member, the following results are established:

electron $\eta\mu\tau < 5\times10^{-9}\ cm^2/V$ hole $\eta\mu\tau = 3.5\times10^{-8}\ cm^2/V$.

Comparing those results, it can be seen that the hole has higher transportation than the electron.

When images are produced with those obtained electrostatic latent image members under such conditions as in Examples 1-4 by such an apparatus as shown in FIG. 3, the ones obtained in examples 1 and 3 produce clear images under positive charge with +20 V of developing bias, and the ones obtained in examples 2 and 4 produce clear images under negative charge with −20 V of developing bias.

In addition, the one obtained in example 3 produces clear images even with 1 μm of film thickness of the photoconductive layer 14. Furthermore, even when such each film thickness of those layers is made to be thinner as that of the blocking layer 13 to be 0.1 μm, that of the photoconductive layer 14 to be 0.8 μm, and that of the surface layer 15 to be 0.1 μm, respectively, clear images can be obtained by reoptimizing a developing unit.

The following examples will examine to trap the electric charge to improve charge performance by thickening B concentration in the vicinity of the surface of the photoconductive layer 14 in the embodiment shown in FIG. 4, or in the surface layer 15 in the embodiment shown in FIG. 5.

EXAMPLE 5

The electrostatic latent image member is formed under such conditions as shown in Table 6.

The electrostatic latent image member is formed with such varied flow ratios of $B_2H_6$ of the surface layer 15 alone as shown in Table 7 and with the same other forming conditions, and quality of its obtained images are similarly examined as aforementioned.

As can be seen from Table 7, the quality of images are inferior with less than 10 ppm of the flow ratio of $B_2H_6/SiH_4$, good within 50 to 200 ppm, and superior with 100 ppm, respectively.

Now, in Example 5, the electrostatic latent image member is produced with such varied film thicknesses of the surface layer 15 alone as shown in Table 8 and with the same other forming conditions, and then quality of its obtained images are similarly examined. In addition, the time necessary for forming the surface layer 15 is varied according to the variation of its film thickness.

As can be seen from Table 8, the quality of the obtained images are inferior with less than 500 Å of film thickness of the surface layer 15, good within 500 to 2000 Å, and superior with 1000 Å, respectively.

EXAMPLE 6

The electrostatic latent image member is formed under such conditions as shown in Table 9.

In Example 6, the electrostatic latent image member is produced with such varied film thicknesses of the surface layer 15 alone as shown in Table 10 and with the same other forming conditions, and the quality of its obtained images are similarly examined. In addition, the time necessary for forming the surface layer 15 is varied according to the variation of its film thickness. Furthermore, a certain gradient is given to B concentration in the surface layer 15.

As may be seen from Table 10, the quality of its obtained images are inferior with less than 200 Å of film thickness of the surface layer 15, good within 200 to 2000 Å, and superior with 1000 Å, respectively.

EXAMPLE 7

The electrostatic latent image member is formed under such conditions as shown in Table 11.

In Example 7, the electrostatic latent image member is produced with such varied film thicknesses of the photoconductive layer 14 alone as shown in Table 12 and with the same other forming conditions, and then the quality of its obtained images are similarly examined. In addition, the time necessary for forming the photoconductive layer 14 is varied according to the variation of its film thickness.

As can be seen from Table 12, more than 0.5 μm of film thickness of the photoconductive layer 14 is necessary for obtaining good images, so is more than 0.7 μm for superior images.

EXAMPLE 8

The electrostatic latent image member not having the surface layer 15 is formed under such conditions as shown in Table 13, as a result, slightly light but good images can be obtained.

EXAMPLE 9

When SiC is employed for forming the photoconductive layer 14 as in Table 14, though sensitivity is slightly reduced but good images can be obtained without the surface layer 15.

EXAMPLE 10

As can be seen from Table 15, when SiC is employed for forming the photoconductive layer 14 as in Table 15, though sensitivity is slightly reduced but good images can be obtained without the surface layer 15.

EXAMPLE 11

When SiC conductive layer 14 is provided with the surface layer 15 with doping B thereon as in Table 16, its charge is increased compared to those in Examples 9 and 10.

EXAMPLE 12

When SiN is employed for forming the photoconductive layer 14 as in Table 17, though sensitivity of its obtained images is slightly reduced but images can be obtained. However, good images can be obtained by reoptimizing a developing unit.

The examples 5, 6, 7, 8 and 11 described above have expressed the cases where $B_2H_6$ doped into the surface layer of the electrostatic latent image member for negative charge, however, an element to dope is not limited to it but another element which belongs to III—a group of the periodic table may be employed, and also the same effects can be obtained. Besides, the electrostatic latent image member for positive charge as described in example 12 can also obtain the similar effects by doping an element which belongs to V—a group of the periodic table into its surface layer.

In the above examples 5, 6, 7 and 8, there are not provided a surface protecting layer on the surface of the photosensitive unit, however, if there is provided a surface protecting layer being made of SiN or SiC with about 1000 Å of film thickness, it may be desirable that the photosensitive unit can have its durability and the like. The surface protecting layer may be formed by such as plasma CVD method.

Further, instead of providing the surface protecting layer, by adding carbon or nitrogen at the same time as doping boron, or the like in the vicinity of the surface of photosensitive unit or in the surface layer, those portions can be used as a surface protecting layer.

In addition, it provides an advantage that no surface protecting layer is necessary by applying alloy material as in examples 9, 10 and 12 to the photoconductive layer.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

TABLE 1

| | | |
|---|---|---|
| $SiH_4$ concentration [$SiH_4/(SiH_4 + H_2)$] | 0.6 | |
| $B_2H_6$ ratio [$B_2H_6/SiH_4$] | 0~1 | ppm |
| Total gas flow rate | 400 | sccm |
| High frequency electric power | 300 | W |
| Reaction pressure | 0.9 | Torr |
| Substrate temperature | 270 | °C. |

TABLE 7

(bias voltage −20 V)

| $B_2H_6/SiH_4$ (ppm) | 0.3 | 1 | 10 | 50 | 100 | 200 | 1000 | 2000 |
|---|---|---|---|---|---|---|---|---|
| Image quality | x | x | Δ | ∘ | ◎ | ∘ | Δ | Δ |

TABLE 8

(bias voltage −20 V)

| Film Thickness (Å) | 100 | 200 | 500 | 1000 | 1500 | 2000 | 5000 |
|---|---|---|---|---|---|---|---|
| Image quality | x | x | Δ | ◎ | ∘ | Δ | x |

TABLE 10

(bias voltage −20 V)

| Film Thickness (Å) | 100 | 200 | 500 | 1000 | 1500 | 2000 | 5000 |
|---|---|---|---|---|---|---|---|
| Image quality | x | Δ | ∘ | ◎ | ∘ | Δ | x |

TABLE 12

(bias voltage −20 V)

| Film Thickness (μm) | 0.3 | 0.5 | 0.7 | 0.9 | 1.3 | 1.5 | 2.0 | 5.0 |
|---|---|---|---|---|---|---|---|---|
| Image quality | x | Δ | ∘ | ◎ | ◎ | ◎ | ◎ | ◎ |

TABLE 2

| | Ts (°C.) | Pressure (torr) | RF (W) | Time (min.) | $SiH_4$ (sccm) | $H_2$ (sccm) | $B_2H_6/SiH_4$ (ppm) | $N_2O/SiH_4$ (%) | $NH_3/SiH_4$ (%) | | Film Thickness (μm) |
|---|---|---|---|---|---|---|---|---|---|---|---|
| Blocking layer | 270 | 1.0 | 200 | 3 | 125 | 200 | 1600 | 30 | 0 | — | 0.3 |
| Photoconductive layer | 270 | 0.9 | 300 | 90 | 250 | 100 | 0 | 0 | 0 | — | 9.0 |
| Surface layer | 270 | 0.6 | 300 | 3 | 100→36 | 0 | 0 | 0 | 80→400 | — | 0.3 |

TABLE 3

| | Ts (°C.) | Pressure (torr) | RF (W) | Time (min.) | $SiH_4$ (sccm) | $H_2$ (sccm) | $B_2H_6/SiH_4$ (ppm) | $PH_3/SiH_4$ (%) | $NH_3/SiH_4$ (%) | | Film Thickness (μm) |
|---|---|---|---|---|---|---|---|---|---|---|---|
| Blocking layer | 270 | 1.0 | 200 | 3 | 125 | 200 | 0 | 1.0 | 0 | — | 0.3 |
| Photoconductive layer | 270 | 0.9 | 300 | 90 | 250 | 100 | 1.0 | 0 | 0 | — | 9.0 |
| Surface layer | 270 | 0.6 | 300 | 3 | 100→36 | 0 | 0 | 0 | 80→400 | — | 0.3 |

TABLE 4

| | Ts (°C.) | Pressure (torr) | RF (W) | Time (min.) | $SiH_4$ (sccm) | $H_2$ (sccm) | $B_2H_6/SiH_4$ (ppm) | $N_2O/SiH_4$ (%) | $NH_3/SiH_4$ (%) | | Film Thickness (μm) |
|---|---|---|---|---|---|---|---|---|---|---|---|
| Blocking layer | 270 | 1.0 | 200 | 2 | 125 | 200 | 1600 | 30 | 0 | — | 0.2 |
| Photoconductive layer | 270 | 0.9 | 300 | 40 | 250 | 100 | 0 | 0 | 0 | — | 4.0 |
| Surface layer | 270 | 0.6 | 300 | 2 | 100→10 | 0 | 0 | 0 | 80→500 | — | 0.2 |

TABLE 5

| | Ts (°C.) | Pressure (torr) | RF (W) | Time (min.) | $SiH_4$ (sccm) | $H_2$ (sccm) | $B_2H_6/SiH_4$ (ppm) | $PH_3/SiH_4$ (%) | $NH_3/SiH_4$ (%) | | Film Thickness (μm) |
|---|---|---|---|---|---|---|---|---|---|---|---|
| Blocking layer | 270 | 1.0 | 200 | 2 | 125 | 200 | 0 | 1.0 | 0 | — | 0.2 |
| Photoconductive layer | 270 | 0.9 | 300 | 50 | 250 | 100 | 1.0 | 0 | 0 | — | 5.0 |
| Surface layer | 270 | 0.6 | 300 | 2 | 100→36 | 0 | 0 | 0 | 80→400 | — | 0.2 |

TABLE 6

| | Ts (°C.) | Pressure (torr) | RF (W) | Time (min.) | $SiH_4$ (sccm) | $H_2$ (sccm) | $PH_3/SiH_4$ (ppm) | $B_2H_6/SiH_4$ (ppm) | $NH_3/SiH_4 + NH_3$ (%) | Film Thickness (μm) |
|---|---|---|---|---|---|---|---|---|---|---|
| Blocking layer | 270 | 0.6 | 200 | 2 | 30 | 200 | — | — | 85 | 0.04 |
| Photoconductive layer | 270 | 1.0 | 300 | 9 | 500 | 100 | — | 0.3 | — | 0.9 |
| Surface layer | 270 | 1.0 | 300 | 1 | 500 | 100 | — | 100 | — | 0.1 |

TABLE 9

| | Ts (°C.) | Pressure (torr) | RF (W) | Time (min.) | $SiH_4$ (sccm) | $H_2$ (sccm) | $PH_3/SiH_4$ (ppm) | $B_2H_6/SiH_4$ (ppm) | $NH_3/SiH_4 + NH_3$ (%) | Film Thickness (μm) |
|---|---|---|---|---|---|---|---|---|---|---|
| Blocking layer | 270 | 0.6 | 200 | 2 | 30 | — | 1000 | — | 50 | 0.04 |
| Photoconductive layer | 270 | 1.0 | 300 | 9 | 500 | 100 | — | 0.1 | — | 0.9 |
| Surface layer | 270 | 1.0 | 300 | 1 | 500 | 100 | — | 50→200 graded | — | 0.1 |

TABLE 11

| | Ts (°C.) | Pressure (torr) | RF (W) | Time (min.) | $SiH_4$ (sccm) | $H_2$ (sccm) | $PH_3/SiH_4$ (ppm) | $B_2H_6/SiH_4$ (ppm) | $NH_3/SiH_4 + NH_3$ (%) | Film Thickness (μm) |
|---|---|---|---|---|---|---|---|---|---|---|
| Blocking layer | 270 | 0.6 | 200 | 2 | 30 | 200 | — | — | 85 | 0.04 |
| Photoconductive layer | 270 | 1.0 | 300 | 9 | 500 | 100 | — | 0.3 | — | 0.9 |
| Surface layer | 270 | 1.0 | 300 | 1 | 500 | 100 | — | 100 | — | 0.1 |

TABLE 13

| | Ts (°C.) | Pressure (torr) | RF (W) | Time (min.) | $SiH_4$ (sccm) | $H_2$ (sccm) | $PH_3/SiH_4$ (ppm) | $N_2O/SiH_4$ (%) | $B_2H_6/SiH_4$ (ppm) | | Film Thickness (μm) |
|---|---|---|---|---|---|---|---|---|---|---|---|
| Blocking layer | 270 | 1.0 | 200 | 1 | 125 | — | 1000 | 50 | — | — | 0.1 |
| Photoconductive layer | 270 | 0.9 | 300 | 9 | 250 | — | — | — | 11 | — | 0.9 |
| Surface layer | — | — | — | — | — | — | — | — | — | — | — |

TABLE 14

| | Ts (°C.) | Pressure (torr) | RF (W) | Time (min.) | $SiH_4$ (sccm) | $H_2$ (sccm) | $PH_3/SiH_4$ (ppm) | $N_2O/SiH_4$ (%) | $C_2H_2/SiH_4$ (%) | | Film Thickness (μm) |
|---|---|---|---|---|---|---|---|---|---|---|---|
| Blocking layer | 270 | 1.0 | 200 | 1 | 125 | 200 | 1000 | 50 | 0 | — | 0.1 |
| Photoconductive layer | 270 | 0.9 | 600 | 9 | 250 | 100 | 0 | 0 | 5 | — | 0.9 |
| Surface layer | — | — | — | — | — | — | — | — | — | — | — |

TABLE 15

| | Ts (°C.) | Pressure (torr) | RF (W) | Time (min.) | $SiH_4$ (sccm) | $H_2$ (sccm) | $PH_3/SiH_4$ (ppm) | $N_2O/SiH_4$ (%) | $CH_4/SiH_4$ (%) | | Film Thickness (μm) |
|---|---|---|---|---|---|---|---|---|---|---|---|
| Blocking layer | 270 | 1.0 | 200 | 1 | 125 | 200 | 1000 | 50 | 0 | — | 0.1 |
| Photoconductive layer | 270 | 0.9 | 600 | 9 | 250 | 100 | 0 | 0 | 7 | — | 0.9 |
| Surface layer | — | — | — | — | — | — | — | — | — | — | — |

TABLE 16

| | Ts (°C.) | Pressure (torr) | RF (W) | Time (min.) | $SiH_4$ (sccm) | $H_2$ (sccm) | $PH_3/SiH_4$ (ppm) | $N_2O/SiH_4$ (%) | $CH_4/SiH_4$ (%) | $B_2H_6/SiH_4$ (ppm) | Film Thickness (μm) |
|---|---|---|---|---|---|---|---|---|---|---|---|
| Blocking layer | 270 | 1.0 | 200 | 1 | 125 | 200 | 1000 | 50 | 0 | 0 | 0.1 |
| Photoconductive layer | 270 | 0.9 | 300 | 8 | 250 | 100 | 0 | 0 | 7 | 0 | 0.8 |
| Surface layer | 270 | 0.6 | 300 | 1 | 250 | 100 | 0 | 0 | 7 | 100 | 0.1 |

TABLE 17

| | Ts (°C.) | Pressure (torr) | RF (W) | Time (min.) | $SiH_4$ (sccm) | $H_2$ (sccm) | | $NH_3/SiH_4$ (%) | | | Film Thickness (μm) |
|---|---|---|---|---|---|---|---|---|---|---|---|
| Blocking layer | 270 | 1.0 | 200 | 1 | 125 | 200 | — | 50 | — | — | 0.1 |
| Photoconductive layer | 270 | 0.9 | 600 | 9 | 250 | 100 | — | 5 | — | — | 0.9 |
| Surface layer | — | — | — | — | — | — | — | — | — | — | — |

What is claimed is:

1. An electrostatic latent image apparatus comprising:

a transparent supporting member having a side through which light energy from a light source may penetrate, and a photosensitive unit on said transparent supporting member having a photoconductive layer and an outer surface that is electrified with an outer surface electric charge which has a polarity, said photosensitive unit having means for forming an electrostatic latent image caused by charge carriers reaching the outer surface; and imagewise exposing means arranged for providing light energy to pass through the side of the transparent supporting member to expose the photoconductive layer of the photosensitive unit and produce imagewise exposure;

said photoconductive layer being responsive to the imagewise exposure for producing the carriers to each have an associated polarity and so that the carriers whose associated polarity is opposite to the polarity of the outer surface electric charge each have a mobility that is greater than that for the carriers whose polarity is the same as that of the outer surface electric charge, the photoconductive layer producing the carriers in response to the light energy penetrating the side of the supporting member and then entering the photoconductive layer, said photosensitive unit being mainly made of amorphous silicon with an element added for trapping the electric charge, said element belonging to any of III—a and V—a groups of the periodic table.

2. An electrostatic latent image apparatus as set forth in claim 1 wherein said photosensitive unit contains 1 to 40 atomic percent of H.

3. An electrostatic latent image apparatus as set forth in claim 1 wherein $B_2H_6$ concentration of said photosensitive unit is 0.2 to 10 ppm.

4. An electrostatic latent image apparatus as set forth in claim 1, wherein said electrostatic latent image member is positively electrified and said element being added in said photosensitive unit is an element which belongs to the III—a group of the periodic table.

5. An electrostatic latent image apparatus as set forth in claim 4 wherein $B_2H_6$ concentration of said photosensitive unit is 0 to 0.4 ppm.

6. An electrostatic latent image apparatus as set forth in claim 1 wherein a protecting layer is provided on the outer surface of said photosensitive unit.

7. An electrostatic latent image apparatus as set forth in claim 1 wherein said photosensitive unit is layered in such order from its outer surface as a surface layer, a photoconductive layer, and a blocking layer.

8. An electrostatic latent image apparatus as set forth in claim 8 wherein said element for trapping an injected electric charge is added to said surface layer.

9. An electrostatic latent image apparatus as set forth in claim 8 wherein said element for trapping an injected electric charge belongs to V—a group of the periodic table in positive charge and to III—a group of the periodic table in negative charge.

10. An electrostatic latent image apparatus as set forth in claim 7 wherein film thickness of said surface layer is 500 Å to 2000 Å.

11. An electrostatic latent image apparatus as set forth in claim 7 wherein said surface layer has a $B_2H_6$ concentration as results from a flow ratio of $B_2H_6$ to $SiH_4$ of 10 to 2000 ppm.

12. An electrostatic latent image apparatus as set forth in claim 7 wherein film thickness of said photoconductive layer is more than 5000 Å.

13. An electrostatic latent image apparatus as set forth in claim 1 wherein said photosensitive unit is layered in such order from its outer surface as a photoconductive layer and a blocking layer.

14. An electrostatic latent image apparatus as set forth in claim 13 wherein said photoconductive layer being added with an element for trapping an injected electric charge.

15. An electrostatic latent image apparatus as set forth in claim 14 wherein the element for trapping an injected electric charge belongs to V—a group of the periodic table in positive charge and to III—a group of the periodic table in negative charge.

16. An electrostatic latent image apparatus comprising:

a transparent supporting member having a side through which light energy from a light source may penetrate;

a photosensitive unit on said supporting member and having a photoconductive layer with an outer surface that is electrified with an outer surface electric charge which has a polarity, said photosensitive unit including forming means for forming an electrostatic latent image caused by charge carriers reaching the outer surface; and imagewise exposing means arranged for providing light energy to pass through the side of the transparent supporting member to expose the photoconductive layer of the photosensitive unit and produce imagewise exposure;

said photoconductive layer being responsive to the imagewise exposure for producing the carriers to each have an associated polarity so that the carriers whose associated polarity is opposite to the polarity of the outer surface electric charge have a mobility which is greater than that for the carriers whose associated polarity is the same as the polarity of the outer surface electric charge, said photoconductive layer producing the carriers in response to the light energy penetrating the side of the supporting member and then entering the photoconductive layer, said photosensitive unit being mainly made of amorphous silicon with an element added for trapping the electric charge being injected, said element belonging to any of III—a and V—a groups of the periodic table.

17. An electrostatic latent image apparatus as set forth in claim 16 wherein said photosensitive unit contains 1 to 40 atomic percent of H.

* * * * *